US005901714A

United States Patent [19]

Benkart

[11] Patent Number: 5,901,714

[45] Date of Patent: May 11, 1999

[54] NAIL POLISH TEMPLATE

[76] Inventor: Marilyn L. Benkart, 1250 Flatbush Rd., Kingston, N.Y. 12401

[21] Appl. No.: 09/057,777

[22] Filed: Apr. 9, 1998

[51] Int. Cl.[6] ..... A45D 29/00; A45D 29/18; A45D 40/30

[52] U.S. Cl. ..... 132/285; 132/73; 132/73.5; 132/319

[58] Field of Search ..... 132/285, 73, 73.5, 132/319

[56] References Cited

U.S. PATENT DOCUMENTS

| | | | |
|---|---|---|---|
| 3,382,878 | 5/1968 | Dinerstein | 132/285 |
| 4,577,648 | 3/1986 | Dinersteins et al. | 132/73 |
| 4,643,208 | 2/1987 | Amour | 132/73 |
| 4,805,645 | 2/1989 | Schiff et al. | 132/73 |
| 4,960,587 | 10/1990 | Rucker | 424/61 |
| 5,143,100 | 9/1992 | Kawakami | 132/285 |

*Primary Examiner*—John J. Wilson
*Assistant Examiner*—Trang Doan

[57] ABSTRACT

A new nail polish template for protecting the skin adjacent a nail from contact with nail polish while painting the nail. The inventive device includes a generally trapezoidal member having top and bottom surfaces, opposite first and second sides, and opposite third and fourth sides extending between the first and second sides of the member. The member also has a plurality of nested portions. Each portion of the member is extended from the first side of member towards the second side of the member. Each of the portions is separable from member to define a cutout.

8 Claims, 2 Drawing Sheets

NAIL POLISH TEMPLATE

BACKGROUND OF THE INVENTION

1. Field of the Invention

The present invention relates to nail grooming devices and more particularly pertains to a new nail polish template for protecting the skin adjacent a nail from contact with nail polish while painting the nail.

2. Description of the Prior Art

The use of nail grooming devices is known in the prior art. More specifically, nail grooming devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art nail grooming devices include U.S. Pat. No. 4,643,208; U.S. Pat. No. 5,150,726; U.S. Pat. No. 4,960,587; U.S. Pat. No. 5,427,121; U.S. Pat. No. 4,718,957; and U.S. Pat. No. Des. 313,286.

While these devices fulfill their respective, particular objectives and requirements, the aforementioned patents do not disclose a new nail polish template. The inventive device includes a generally trapezoidal member having top and bottom surfaces, opposite first and second sides, and opposite third and fourth sides extending between the first and second sides of the member. The member also has a plurality of nested portions. Each portion of the member is extended from the first side of member towards the second side of the member. Each of the portions is separable from member to define a cutout.

In these respects, the nail polish template according to the present invention substantially departs from the conventional concepts and designs of the prior art, and in so doing provides an apparatus primarily developed for the purpose of protecting the skin adjacent a nail from contact with nail polish while painting the nail.

SUMMARY OF THE INVENTION

In view of the foregoing disadvantages inherent in the known types of nail grooming devices now present in the prior art, the present invention provides a new nail polish template construction wherein the same can be utilized for protecting the skin adjacent a nail from contact with nail polish while painting the nail.

The general purpose of the present invention, which will be described subsequently in greater detail, is to provide a new nail polish template apparatus and method which has many of the advantages of the nail grooming devices mentioned heretofore and many novel features that result in a new nail polish template which is not anticipated, rendered obvious, suggested, or even implied by any of the prior art nail grooming devices, either alone or in any combination thereof.

To attain this, the present invention generally comprises a generally trapezoidal member having top and bottom surfaces, opposite first and second sides, and opposite third and fourth sides extending between the first and second sides of the member. The member also has a plurality of nested portions. Each portion of the member is extended from the first side of member towards the second side of the member. Each of the portions is separable from member to define a cutout.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new nail polish template apparatus and method which has many of the advantages of the nail grooming devices mentioned heretofore and many novel features that result in a new nail polish template which is not anticipated, rendered obvious, suggested, or even implied by any of the prior art nail grooming devices, either alone or in any combination thereof.

It is another object of the present invention to provide a new nail polish template which may be easily and efficiently manufactured and marketed.

It is a further object of the present invention to provide a new nail polish template which is of a durable and reliable construction.

An even further object of the present invention is to provide a new nail polish template which is susceptible of a low cost of manufacture with regard to both materials and labor, and which accordingly is then susceptible of low prices of sale to the consuming public, thereby making such nail polish template economically available to the buying public.

Still yet another object of the present invention is to provide a new nail polish template which provides in the apparatuses and methods of the prior art some of the advantages thereof, while simultaneously overcoming some of the disadvantages normally associated therewith.

Still another object of the present invention is to provide a new nail polish template for protecting the skin adjacent a nail from contact with nail polish while painting the nail.

Yet another object of the present invention is to provide a new nail polish template which includes a generally trapezoidal member having top and bottom surfaces, opposite first and second sides, and opposite third and fourth sides extending between the first and second sides of the member. The member also has a plurality of nested portions. Each portion of the member is extended from the first side of member towards the second side of the member. Each of the portions is separable from member to define a cutout.

Still yet another object of the present invention is to provide a new nail polish template that is adaptable to fit various sizes of nails.

Even still yet another object of the present invention is to provide a new nail polish template that helps a user paint their nails with clean and straight outer perimeters.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
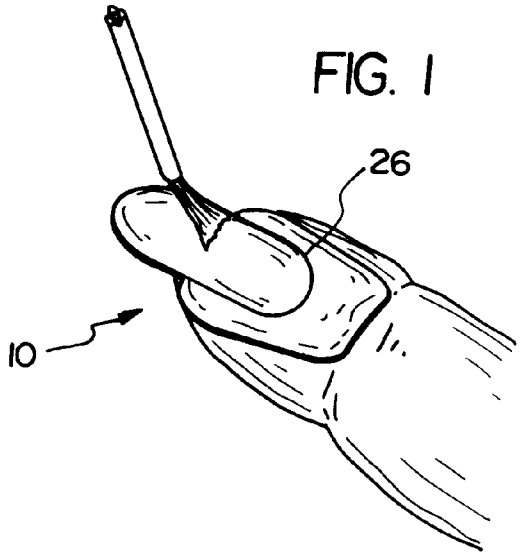
FIG. 1 is a schematic perspective view of a new nail polish template in use according to the present invention.
Figure 2:
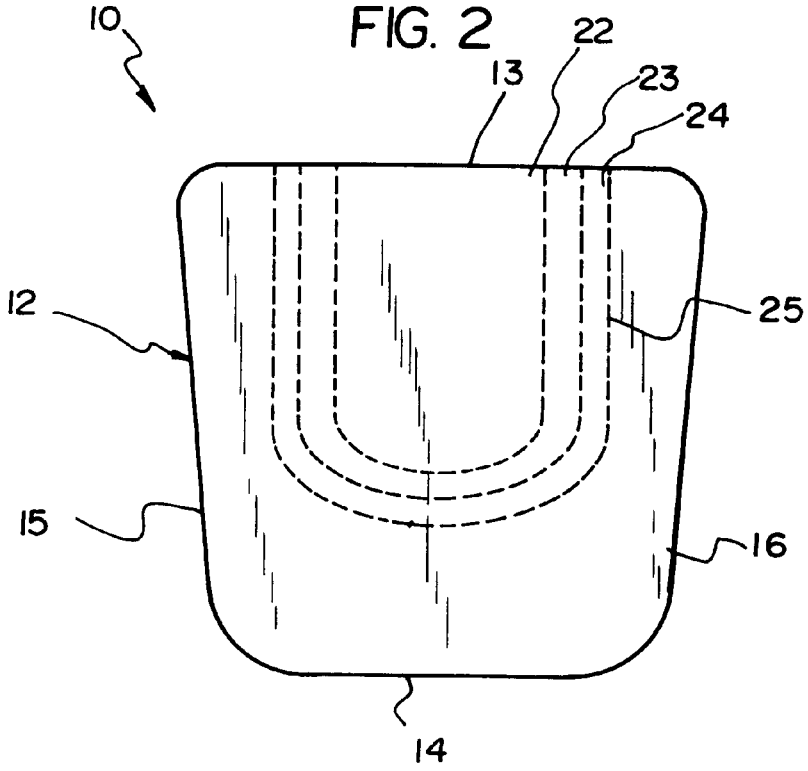
FIG. 2 is a schematic top side view of the present invention.
Figure 3:
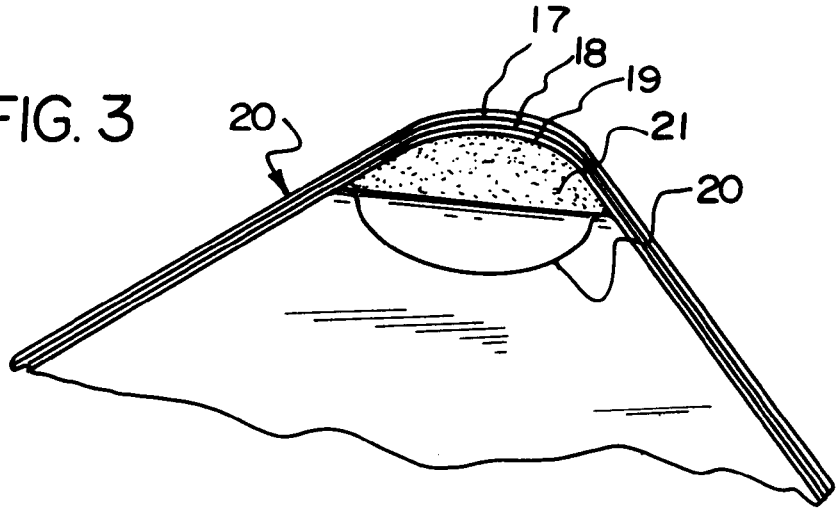
FIG. 3 is a schematic partial back side view of the present invention illustrating the backing sheet.
Figure 4:
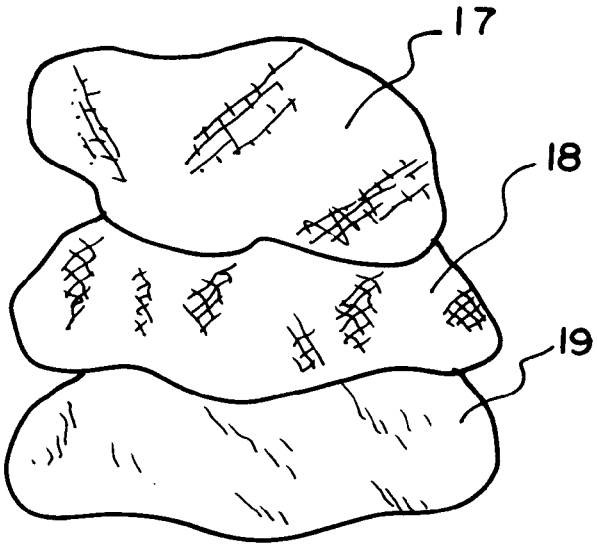
FIG. 4 is a schematic view illustrating the layers of the member of the present invention.

With reference now to the drawings, and in particular to FIGS. 1 through 4 thereof, a new nail polish template embodying the principles and concepts of the present invention and generally designated by the reference numeral 10 will be described.

As best illustrated in FIGS. 1 through 4, the nail polish template 10 generally comprises a generally trapezoidal member 12 having top and bottom surfaces, opposite first and second sides 13,14, and opposite third and fourth sides 15,16 extending between the first and second sides 13,14 of the member 12. The member 12 also has a plurality of nested portions 22,23,24. Each portion of the member 12 is extended from the first side 13 of member 12 towards the second side of the member 12. Each of the portions 22,23,24 is separable from member 12 to define a cutout 26.

As illustrated in FIG. 1, the template 10 is designed for attaching to a finger or toe so that the cutout 26 is positioned over the nail of the finger or toe with the rest of the member 12 covering the skin adjacent the nail. This protects the skin from contact with nail polish when a user is painting their nails. Specifically, the member 12 of the template is generally trapezoidal and has top and bottom surfaces, a plurality of corners, opposite first and second sides 13,14, and opposite third and fourth sides 15,16 extending between the first and second sides 13,14 of the member 12. The third and fourth sides 15,16 taper from the first side 13 towards the second side. The member 12 is trapezoidal for providing maximum coverage to the skin adjacent a nail. Preferably, the corners of the member 12 are rounded for preventing the corners from accidentally poking the skin under a nail.

A member 12 length is defined between the first and second sides 13,14. Additionally, wherein the first side 13 of the member 12 has a length. Preferably, the length of the first side 13 of the member 12 is less than $\frac{2}{3}^{rd}$ the member 12 length. Ideally, the member 12 length is less than about 1¼ inches, and the length of the first side 13 is less than about ¾ inch. In the preferred embodiment of the invention, the member 12 also includes top, middle and bottom layer 19s. The top layer 17 is located towards the upper surface of the member 12 while the bottom layer 19 is located towards the lower surface of the member 12. Ideally, the top layer 17 is partially liquid absorbent and is constructed from a woven material to permit liquid to pass through it. In this ideal embodiment, the middle layer 18 is liquid absorbing and is preferably constructed from cotton. The bottom layer 19 comprises an adhesive 21 and is designed for adhesively coupling the member 12 to a skin surface. Preferably, a removable backing sheet 20 is adhesively coupled to the bottom layer 19 of the member 12. The backing sheet 20 is designed for protecting debris from sticking to the adhesive 21 layer.

The member 12 also has a plurality of nested portions 22,23,24. Each portion of the member 12 is extended from the first side 13 of member 12 towards the second side of the member 12. Each of the portions 22,23,24 is also separable from member 12 so that each may define a cutout 26. The cutouts are designed for positioning over a nail of a finger or a toe so that the nail is exposed when the member 12 is attached to the skin around the nail. Preferably, each of the cutouts has a generally U-shaped periphery having a pair of spaced apart substantially parallel straight regions and an arcuate region extending between the pair of straight regions. Ideally, the member 12 has a plurality of perforations 25 between each of the portions 22,23,24 of the member 12. The perforations 25 are designed for aiding detachment of the portions 22,23,24 from the member 12.

In use, a portion is removed from the member 12 to define a cutout 26. The member 12 is positioned on a finger (or a toe) so that the cutout 26 is positioned over the nail of the finger. The back surface of the member 12 is adhesively coupled to the skin of the finger such that the nail is exposed in the cutout 26 while the skin adjacent the nail is cover by the member 12. Preferably, the arcuate portion of the cutout 26 is located at the root of the nail for best covering the skin adjacent the nail.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A template for covering skin adjacent a nail, said template comprising:

a member being generally trapezoidal and having top and bottom surfaces, a plurality of corners, opposite first and second sides, opposite third and fourth sides extending between said first and second sides of said member, said third and fourth sides tapering from said first side towards said second side;

said member having a plurality of nested portions, each portion of said member being extended from said first side of member towards said second side of said member, each of said portions being separable from member to define a cutout; and wherein said member has top, middle and bottom layers, said top layer being located towards said upper surface of said member, said bottom layer being located towards said lower surface of said member, wherein said top layer is partially liquid absorbent and comprising a woven material to permit liquid to pass therethrough, wherein said middle layer is liquid absorbing, wherein said middle layer comprises cotton, wherein said bottom layer comprises an adhesive.

2. The template of claim 1, wherein said corners of said member are rounded.

3. The template of claim 1, wherein a member length is defined between said first and second sides, wherein said first side of said member having a length, and wherein said length of said first side is less than $\frac{2}{3}^{rd}$ said member length.

4. The template of claim 3, wherein said member length is less than about 1¼ inches; and wherein said length of said first side is less than about ¾ inch.

5. The template of claim 1, further comprising a backing sheet being adhesively coupled to said bottom layer of said member.

6. The template of claim 1, wherein each of said cutouts has a generally U-shaped periphery, each of said peripheries of said cutouts having a pair of spaced apart substantially parallel straight regions and an arcuate region being extended between said pair of straight regions.

7. The template of claim 1, wherein said member has a plurality of perforations between each of said portions of said member.

8. A template for covering skin adjacent a nail, said template comprising:

a member being generally trapezoidal and having top and bottom surfaces, a plurality of corners, opposite first and second sides, opposite third and fourth sides extending between said first and second sides of said member, said third and fourth sides tapering from said first side towards said second side;

wherein said corners of said member are rounded;

wherein a member length is defined between said first and second sides, wherein said member length is less than about 1¼ inches;

wherein said first side of said member having a length, wherein said length of said first side is less than about ¾ inch;

wherein said member has top, middle and bottom layers, said top layer being located towards said upper surface of said member, said bottom layer being located towards said lower surface of said member, wherein said top layer is partially liquid absorbent and comprising a woven material to permit liquid to pass therethrough, wherein said middle layer is liquid absorbing, wherein said middle layer comprises cotton, wherein said bottom layer comprises an adhesive;

a backing sheet being adhesively coupled to said bottom layer of said member;

said member having a plurality of nested portions, each portion of said member being extended from said first side of member towards said second side of said member, each of said portions being separable from member to define a cutout, each of said cutouts having a generally U-shaped periphery, each of said peripheries of said cutouts having a pair of spaced apart substantially parallel straight regions and an arcuate region being extended between said pair of straight regions; and wherein said member has a plurality of perforations between each of said portions of said member.

* * * * *